US005548302A

United States Patent [19]

Kuwata et al.

[11] Patent Number: 5,548,302

[45] Date of Patent: Aug. 20, 1996

[54] METHOD OF DRIVING DISPLAY ELEMENT AND ITS DRIVING DEVICE

[75] Inventors: Takeshi Kuwata; Temkar N. Ruckmongathan; Yutaka Nakagawa; Hidemasa Koh; Akira Nakazawa; Takanori Ohnishi; Satoru Ihara, all of Yokohama, Japan

[73] Assignee: Asahi Glass Company Ltd., Tokyo, Japan

[21] Appl. No.: 98,812

[22] Filed: Jul. 29, 1993

[30] Foreign Application Priority Data

| | | | |
|---|---|---|---|
| Jul. 29, 1992 | [JP] | Japan | 4-222053 |
| Sep. 11, 1992 | [JP] | Japan | 4-269560 |
| Feb. 9, 1993 | [JP] | Japan | 5-044565 |

[51] Int. Cl.[6] ..... G09G 3/36

[52] U.S. Cl. ..... 345/89; 345/95; 345/100

[58] Field of Search ..... 345/93, 98–100, 345/87, 148; 359/55

[56] References Cited

U.S. PATENT DOCUMENTS 5,262,881 11/1993 Kuwata et al. ..... 345/93

FOREIGN PATENT DOCUMENTS 0507061 10/1992 European Pat. Off. .
0522510 1/1993 European Pat. Off. .
0569974 11/1993 European Pat. Off. .

OTHER PUBLICATIONS

Conference Record of the 1988 International Display Research Conference, T. N. Ruckmongathan, "A Generalized Addressing Technique for RMS Responding Matrix LCDS", pp. 80–85.

Semicon/Kansai–Kyoto Technology Seminar 93 Proceedings–FPD–, pp. 81–86, (with English abstract).

Annual of Liquid Crystal Display Industries, 1993, pp. 26–43.

Technical Report of The Institute of Electronics, Information and Communication Engineers, EID 92–84, (1992–12), T. KUWATA, et al., "A New Addressing Technique For Fast Responding STN LCDs–SAT (Sequency Addressing Technique)", pp. 47–52, (with English Abstract).

Japan Display '92, B. Clifton, et al., "Hardware Architectures for Video–Rate, Active Addressed STN Displays", pp. 503–506.

Japan Display '92, T. N. Ruckmongathan, "Addressing Techniques for RMS Responding LCDs–A Review", pp. 77–80.

Japan Display '92, A. R. Conner, et al., "Pulse–Height Modulation (PHM) Gray Shading Methods for Passive Matrix LCDs", pp. 69–76.

A. R. Kmetz, J. Nehring, "Ultimate Limits for RMS Matrix Addressing" Symp. Phys. Chem Liquid Crystal Devices Plenum Press 1980 pp. 105–113.

*Primary Examiner*—Steven Saras
*Attorney, Agent, or Firm*—Oblon, Spivak, McClelland, Maier, & Neustadt, P.C.

[57] ABSTRACT

A method of driving a display element wherein a light transmittance of a pixel selected by a row electrode and a column electrode changes in accordance with a difference between voltages applied on the row electrode and the column electrode, is employed which satisfies several conditions.

10 Claims, 8 Drawing Sheets

METHOD OF DRIVING DISPLAY ELEMENT AND ITS DRIVING DEVICE

The present invention relates to a method of gray-shade-driving a display element such as a fast responding liquid crystal display element and its device.

In recent years, liquid crystal display elements have been noted as devices which are thin, light, compact and capable of displaying a large capacity of information, in place of CRTs. As liquid crystal display elements, they are mainly classified into two devices wherein each pixel of a twisted nematic (TN) type liquid crystal display element is driven by a thin-film transistor which is disposed in correspondence to each of the pixels, and a twisted nematic (TN) type or a super-twisted nematic (STN) type liquid crystal display element is driven without using a thin-film transistor (a simple matrix type).

There is a problem in the liquid crystal display element employing the thin-film transistor, wherein manufacturing steps for preparing the element are complicated and manufacturing cost is high. On the other hand, there is a problem in the simple matrix type liquid crystal display element, wherein they are not suitable for a multi-level gray shade display, although the manufacturing steps of the element are comparatively simple.

The driving of the conventional simple matrix type liquid crystal display element is performed by a so-called frame modulation or pulse-width-modulation. In case of the frame modulation, low frequency components of a driving waveform increases and flickers are apt to generate. Further, in case of the pulse-width modulation, high frequency components of a driving waveform increase and a nonuniformity of display is apt to generate.

Two methods for generating a large number of gray shades in rms responding matrix LCDs are proposed in the present invention which shall be referred to as AMPLITUDE MODULATION.

It is an object of the present invention to solve the above problems and to provide the following methods of driving a display element and driving devices of a display element.

In general, it is necessary to change the rms voltage across a pixel to achieve gray shades in a display.

The rms voltage across a pixel can be changed by varying the amplitude of the column voltage. However, this results in changing the rms voltage across all the pixels in that column. It is important to note that the amplitude of column voltage is same while the polarity with respect to row select pulse is changed depending on the data in the conventional technique. This ensures that rms voltage across a pixel is independent of the data displayed in a column.

In the present invention, the amplitude of the column voltage is selected to change the rms voltage across a pixel. However, the choice of column voltage is such that the voltage across pixels in the unselected rows is constant in a cycle and is independent of the data displayed.

According to a first aspect of the present invention, there is provided a method of driving a display element wherein a light transmittance of a pixel selected by a row electrode and a column electrode changes in accordance with a difference between voltages applied on the row electrode and the column electrode, which satisfies the following conditions:

(1) row electrodes are divided into a plurality of row electrode subgroups composed of L row electrodes which are selected simultaneously wherein L is an integer greater than 1:

(2) signals $\{\alpha_{mn}\}$ where $\alpha_{mn}$ is an element of a m-th row component and a n-th column component of an orthogonal matrix, m is an integer of 1 through L and n is a suffix showing that the n-th column component of the orthogonal matrix corresponds to a n-th selection signal in a single display cycle are applied on the selected row electrodes as row electrode signals:

(3) a signal into which an image signal corresponding to positions of the selected row electrodes on a display panel is converted by the orthogonal function is applied on a column electrode as a column electrode signal: and (4) a first voltage which is in proportion to a second voltage $V_d$ expressed by the following equation is substantially applied to a column voltage to provide a predetermined gray shade level $d_{(j\cdot L+i),k}$ which is a value between 1 showing an off state and −1 showing an on state in accordance with a degree of gray shade with respect to a pixel of a k-th column where k is an integer and an i-th row where i is an integer of 1 through L of a j-th row electrode subgroup where j is an integer:

$$V_d = \sum_{i=0}^{L} \{\alpha_{in}' \cdot d_{(j\cdot L+i),k}\}, \tag{1}$$

where $$d_{(j\cdot L+0),k} = \left( L - \sum_{i=1}^{L} \{d_{(j\cdot L+i),k}\}^2 \right)^{1/2}, \tag{2}$$

where $$\sum_{i=0}^{L}$$

{ } indicates a summing operation of a content of { } with respect to i=0 through L and $\alpha_{in}'$ indicates an element of an i-th row component and a n-th column component of an orthogonal matrix wherein a 0-th row component is added to $\{\alpha_{mn}\}$.

According to a second aspect of the present invention, there is provided a method of driving a display element according to the first aspect, wherein the number L of the simultaneously selected row electrodes satisfies $$L=2^p-1$$

where p is an integer greater than 1.

According to a third aspect of the present invention, there is provided a method of driving a display element according to the first aspect, wherein the number L of the simultaneously selected row electrodes satisfies $$L=2^p-2$$

where p is an integer greater than 2.

According to a fourth aspect of the present invention, there is provided a method of driving a display element according to the first aspect, wherein the display element is a liquid crystal display element.

According to a fifth aspect of the present invention, there is provided a method of driving a display element according to the fourth aspect, wherein selected pulses are dispersingly applied on the row electrodes in the single display cycle to thereby prevent relaxation phenomena of a liquid crystal.

According to a sixth aspect of the present invention, there is provided a method of driving a display element wherein a light transmittance of a pixel selected by a row electrode and a column electrode changes in accordance with a difference between voltages applied on the row electrode and the column electrode, which satisfies the following conditions:

(1) Row electrodes are divided into a plurality of row electrode subgroups composed of L row electrodes which are selected simultaneously wherein L is an integer greater than 1:

(2) signals $\{\alpha_{mn}\}$ where $\alpha_{mn}$ is an element of a m-th row component and a n-th column component of an orthogonal matrix, m is an integer of 1 through L and n is a suffix showing that the n-th column component of the orthogonal matrix corresponds to a n-th selection signal in a single display cycle are applied on the selected row electrodes as row electrode signals:

(3) a signal into which an image signal corresponding to positions of the selected row electrodes on a display panel is converted by the orthogonal function is applied on a column electrode as a column electrode signal: and (4) first voltages which are proportional to two kinds of second voltages expressed by the following equations are substantially applied to a column electrode to provide a predetermined gray shade level $d_{(j\cdot L+i),k}$ which is a value between 1 showing an off state and −1 showing an on state in accordance with a degree of gray shade with respect to a pixel of a k-th column where k is an integer and an i-th row where i is an integer of 1 through L of a j-th row electrode subgroup where j is an integer:

$$V_{d1,n}=\sum_{i=1}^{L}\{\alpha_{in}(d_{(j\cdot L+i),k}+(1-d^2_{(j\cdot L+i),k})^{1/2}\} \quad (3)$$

$$V_{d2,n}=\sum_{i=1}^{L}\{\alpha_{in}(d_{(j\cdot L+i),k}-(1-d^2_{(j\cdot L+i),k})^{1/2}\} \quad (4)$$

where $$\sum_{i=1}^{L}$$

{ } indicates a summing operation of a content of { } with respect to i=0 through L.

According to a seventh aspect of the present invention, there is provided a method of driving a display element according to the sixth aspect, wherein the number L of the simultaneously selected row electrodes satisfies $$L=2^p-1,$$

where p is an integer greater than 1.

According to an eighth aspect of the present invention, there is provided a method of driving a display element according to the sixth aspect, wherein the display element is a liquid crystal display element.

According to a ninth aspect of the present invention, there is provided a method of driving a display element according to the eighth aspect, wherein selected pulses are dispersingly applied on the row electrodes in the single display cycle to thereby prevent relaxation phenomena of a liquid crystal.

According to a tenth aspect of the present invention, there is provided a method of driving a display element according to the eighth aspect, wherein $V_{d1,n}$ and $V_{d2,n}$ are dispersingly applied on the column electrodes in two display cycles to thereby prevent relaxation phenomena of a liquid crystal.

According to an eleventh aspect of the present invention, there is provided a driving device of a display element for driving a display element wherein a light transmittance of a pixel selected by a row electrode and a column electrode changes in accordance with a difference between voltages applied on the row electrode and the column electrode by dividing row electrodes into a plurality of row electrode subgroups composed of L row electrodes which are selected simultaneously wherein L is an integer greater than 1;

wherein a column signal generating device in the driving device comprises the following elements to provide a predetermined gray shade level $d_{(j\cdot L+i),k}$, which is a value between 1 showing an off state and −1 showing an on state in accordance with a degree of gray shade with respect to a pixel of a k-th column where k is an integer and an i-th row where i is an integer of 1 through L of a j-th row electrode subgroup where j is an integer:

(1) a function generating means for generating a function of $$d_{(j\cdot L+0),k}=\left(L-\sum_{i=1}^{L}\{d^2_{(j\cdot L+i),k}\}\right)^{1/2} \quad (5)$$

with respect to a display data $d_{(j\cdot L+i),k}$ corresponding to a predetermined gray shade level;

(2) a sign determining means for determining signs of an output $d_{(j\cdot L+O),k}$ of the function generating means and the display data $d_{(j\cdot L+i),k}$ in accordance with an orthogonal function signal $[\alpha_{mn}]$ where $\alpha_{mn}$ is an element of a m-th row component and a n-th column component of an orthogonal matrix, m is an integer of 1 through L and n is a suffix showing that the n-th column component of the orthogonal matrix corresponds to a n-th selection signal in a single display cycle; and (3) an adding means for adding the output $d_{(j\cdot L+O),k}$ and the display data $d_{(j\cdot L+i),k}$ of which signs are determined by the sign determining means.

According to a twelfth aspect of the present invention, there is provided a driving device of a display element according to the eleventh aspect, wherein the display element is a liquid crystal display element.

According to a thirteenth aspect of the present invention, there is provided a driving device of a display element for driving a display element wherein a light transmittance of a pixel selected by a row electrode and a column electrode changes in accordance with a difference between voltages applied on the row electrode and the column electrode by dividing row electrodes into a plurality of row electrode subgroups composed of L row electrodes which are selected simultaneously wherein L is an integer greater than 1;

wherein a column signal generating device in the driving device comprises the following elements to provide a predetermined gray shade level $d_{(j\cdot L+i),k}$, which is a value between 1 showing an off state and −1 showing an on state in accordance with a degree of gray shade with respect to a pixel of a k-th column where k is an integer and an i-th row where i is an integer of 1 through L of a j-th row electrode subgroup where j is an integer:

(1) a first function generating means for generating a first function of $$F_{i1}=d_{(j\cdot L+i),k}+(1-d_{(j\cdot L+i),k}{}^2)^{1/2} \quad (6)$$

with respect to a display data $d_{(j\cdot l+i),k}$ corresponding to a predetermined gray shade level;

(2) a second function generating means for generating a second function of $$F_{i2}=d_{(j\cdot L+i),k}-(1-d_{(j\cdot L+i),k}{}^2)^{1/2} \quad (7)$$

by inputting the display data $d_{(j\cdot L+i),k}$ corresponding to a predetermined gray shade level;

(3) a sign determining means for determining signs of $F_{i1}$ and $F_{i2}$ in accordance with an orthogonal function signal $\{\alpha_{mn}\}$ where $\alpha_{mn}$ is an element of a m-th row component and a n-th column component of an orthogonal matrix, m is an integer of 1 through L and n is a suffix showing that the n-th column component of the orthogonal matrix corresponds to a n-th selection signal in a single display cycle;

(4) a switching means for switching outputs of the first and the second function determining means of which signs are to be determined by the sign determining means at a predetermined timing; and (5) an adding means for adding $F_{i1}$ and $F_{i2}$ of which signs have been determined by the sign determining means.

According to a fourteenth aspect of the present invention, there is provided a driving device of a display element according to the thirteenth aspect, wherein the first or the second function generating means is constructed by random logic gates and the switching means is constructed by an AND-OR gate.

According to a fifteenth aspect of the present invention, there is provided a driving device of a display element according to the thirteenth aspect, wherein the first or the second function generating means is constructed by storing a result of calculation corresponding to a predetermined gray shade level into a ROM and the switching means is constructed by a means for switching an address with respect to the ROM in reading.

According to a sixteenth aspect of the present invention, there is provided a driving device of a display element according to the thirteenth aspect, wherein the display element is a liquid crystal display element.

A specific explanation will be given to the present invention. First, an explanation will be given of a gray-shade-driving in case of the traditional optimized amplitude selective addressing method for driving a simple matrix type liquid crystal display element.

There is a case wherein a reference level of voltage is shifted for each frame, to lower a driving voltage as a whole. This is a so-called IAPT method: see for instance, H. Kawakami, Y. Nagae and E. Kaneko, "Matrix Addressing Technology of Twisted Nematic Liquid Crystal Display", SID-IEEE Record of Biennial Display Conference p. 50–52, 1976). However, an explanation will be given mainly to a case wherein the reference level is not shifted, for simplicity in this specification. (This is the so-called APT method; see for instance, Alt, P. M. and Pleshko, P., "Scanning Limitations of Liquid Crystal Displays", IEEE Trans. ED, Vol. ED21, pp. 146–155, 1974). However, the application to the IAPT method can be performed extremely easily by regarding an application voltage in the APT method as a voltage amplitude from a changing intermediate voltage.

In this case, assuming an absolute value of a selection voltage of a row electrode as $V_r$ ($V_r > 0$) and a non-selection voltage as 0, a voltage of $V_r$ or $-V_r$ is applied on the row electrode.

On the other hand, a gray shade level of display is indicated by $g_1$, where $g_1$ is provided with a value between 1 showing an off state and −1 showing an on state in accordance with a degree of gray shade. For instance, in case of four gray shades, $g_1$ is provided with −3/3, −1/3, 1/3 and 3/3. Further, in case of 16 gray shades, $g_1$ is provided with −15/15, −13/15 , . . . , 13/15 and 15/15. However, in a general liquid crystal display element, the voltage-light transmittance curve is not a straight line. It often is not preferable to distribute values of $g_1$ at uniform intervals. It is preferable to suitably set the intervals between respective gray shades in accordance with the voltage-light transmittance curve.

When the first method of the present invention is applied to the APT method, it is preferable to prepare two kinds of voltages which are to be supplied to column electrodes, in case wherein the row electrodes are provided with a constant $V_r$.

Row select time is split into two equal time intervals. Column voltage is proportional to $(g_1+k)$ in one of the time intervals and $(g_1-k)$ in the other time intervals for the row selection voltage $V_r$, where $k^2=1-g_1^2$. Polarities of row and column voltages are changed to achieve dc free operation. Further, the constant of proportion is suitably selected such that the contrast ratio is maximized in accordance with characteristics of a liquid crystal element.

The above two kinds of voltages are successively applied on the side of column electrodes. However, the timing and the order of application can freely be changed in this invention. For instance, as shown in FIG. 1, $(g_1+k)$ and $(g_1-k)$ with respect to $V_r$ may successively be applied, and as shown in FIG. 2, only one of them may be applied and the other one may be applied after scanning all of the row electrodes. $V_c$ is a constant of proportion in FIGS. 1 and 2.

The applicants have already proposed a method of driving a fast responding liquid crystal display element wherein the relaxation phenomena of liquid crystal is restrained and the contrast ratio is prevented from lowering, by simultaneously selecting a plurality of column electrodes and by dispersing selection pulses in a single display cycle. See for instance, Japanese Patent Application No. 148844/1992. Hereinafter, this method is called MLS (multi line selection) method.

In this specification, "a cycle" means minimum number of time interval necessary for addressing and dc free operation.

The method of this invention is a MLS method which is generalized as follows. In the MLS method, a row electrode subgroup consisted of L pieces of row electrode is summerizingly selected.

(1) An orthogonal matrix A having L row components and K column components, of which element is composed of +1 corresponding to the voltage $+V_r$ or −1 corresponding to the voltage $-V_r$, is selected as a selection voltage matrix.

(2) In selecting a j-th row electrode subgroup, a voltage is applied such that an element of a column vector of the selection voltage matrix (hereinafter, selection voltage vector) corresponds to a voltage amplitude at row electrodes constituting the j-th row electrode subgroup. The voltage application is performed with respect to all of the selection voltage vectors.

The group of row electrodes which are simultaneously selected, is called "a row electrode subgroup". It is preferable to have the same numbers of row electrodes constituting the row electrode subgroups. However, when it is not possible to have the same numbers of the row electrodes constituting the respective row electrode subgroups when the total number of rows is not an integral multiple of L, the driving may be performed by assuming dummy row electrodes, such that numbers of row electrodes which are incorporated in all the row electrode subgroups are regarded as equal.

A liquid crystal display element should preferably have short response time (typically 50 msec or less). The liquid crystal display element having a short response time can be provided by reducing a thickness d of a liquid crystal layer, as well as employing a liquid crystal having a low viscosity and a large anisotropy of the refractory index. As a material of liquid crystal which satisfies the above conditions, a tolan species (Japanese Unexamined Patent Publication No. 5631/1986), a difluorostilbene species (Japanese Unexamined Patent Publication No. 96475/1989) or the like is pointed out.

The voltage applied to the row electrode is provided with either one of voltage levels of $+V_r$ and $-V_r$ ($V_r>0$) in selection time, when the voltage in non-selection time is determined to be 0. In this case, the voltage 0 in non-selection time does not necessarily mean the grounding to the earth. The driving voltage of the liquid crystal element is determined by a voltage (potential difference) applied between a row electrode and a column electrode, and the potential difference between the both electrodes does not change even when the potentials of the both electrodes are simultaneously changed by the same amounts.

The voltage in selection time which is applied to a specified row electrode subgroups, is expressed by a group wherein vectors having L pieces of elements which are the voltages applied to respective row electrodes are arranged sequentially or over time. This vector is designated by "selection voltage vector". Further, a matrix including the selection voltage vectors as its column components, is designated by "selection voltage matrix".

An orthogonal matrix is selected as the selection voltage matrix of which element is basically composed of +1 corresponding to the voltage $+V_r$ or −1 corresponding to the voltage $-V_r$. The number of row components of the selection voltage matrix is equal to the number of row electrodes included in the row electrode subgroup, whereas the number of column components is equal to the number of selection pulses included in a single display cycle. When the number of column components is too large, the number of selection pulses necessary for a single display cycle in selecting of the row electrode becomes large. Therefore, the number of column components is preferably a minimum value among possible values. Further, when the selection voltage applied to the respective column electrodes is not an alternate current voltage, it is possible to make the selection voltage an alternate current voltage by employing an orthogonal matrix −A in succession to the orthogonal matrix A and by driving the respective column electrodes by regarding the combination of matrices to be the selection voltage matrix as a whole.

Further, it is considerably effective to adopt especially Hadamard's matrix as the selection voltage matrix, in order to restrain a nonuniformity of display caused by a frequency dependency of a liquid optical display's threshold voltage. The order of the sequential arrangement of the selection voltage vector which is employed in the driving, is arbitrary, and it is possible to shift or switch the selection voltage vectors with respect to each row electrode subgroup, or each display data. It is often preferable to drive the liquid crystal by suitably performing the above switching, in order to restrain the nonuniformity of display in the actual driving.

Similarly, the different orthogonal matrices which are obtained by interchanging the row components of the selection voltage matrix A can be employed in a successive display cycle, to reduce the nonuniformity of display.

In summary, the above driving method is provided with the following characteristics.

(1) Row electrodes are classified into a plurality of row electrode subgroups composed of L row electrodes which are selected simultaneously wherein L is an integer greater than 1.

(2) A signal $\{\alpha_{mn}\}$ of an orthogonal function wherein $\alpha_{mn}$ designates an element of a m-th row component and a n-th column component of an orthogonal matrix, m is an integer of 1 through L and n is a suffix showing that the n-th column component of the orthogonal matrix corresponds to a n-th selection signal in a single display cycle, is applied on a selected row electrode as a row electrode signal.

(3) A signal to which an image signal with respect to positions of the selected row electrodes on a display panel is converted by the orthogonal function, is applied on the column electrode as a column electrode signal.

Next, the timings wherein the selection pulses designated by the selection voltage vectors constructed as above are applied on the respective row electrode, will be explained as follows.

The prevention of a frame response (relaxation phenomena of a liquid crystal) in a liquid crystal element having a fast response can be performed by shortening a length of non-selection time period in row waveforms, by dispersing the selection pulses in a single display cycle. Generally speaking, it is more effective to prevent the relaxation phenomena of a liquid crystal by selecting the successive row electrode subgroups sequentially one after another.

Hereinafter, the orthogonal matrix A is designated by $\{\alpha_{mn}\}$ to clarify the expression. $\alpha_{mn}$ designates an element of a m-th row component and a n-th column component of this orthogonal matrix. m is an integer of 1 through L. n is a suffix showing that the above expression corresponds to a n-th selection signal in one display cycle. According to this expression, an i-th row is selected by applying a voltage of $V_r \cdot \alpha_{in}$ ($V_r$ is a positive number) by expanding it in the time axis with respect to each n. That it to say, the row electrode is applied with the voltage of $V_r \cdot \alpha_{in}$ with respect to the non-selection voltage, in selection time.

On the other hand, the gray shade level of display of an element at a k-th column and an i-th row in a j-th row electrode subgroup (j is an integer of 0 through J−1), is designated as $d_{(j \cdot L+i),k} \cdot d_{(j \cdot L+i),k}$ is provided with normalized values between 1 showing an off state and −1 showing an on state in accordance with the levels of gray shade. For instance, in case of 4 levels of gray shades, it can be provided with −3/3, −1/3, 1/3 and 3/3, and in case of 16 levels of gray shades, −15/15, −13/15 , . . . 13/15 and 15/15. However, in a general liquid crystal display element, it is often not preferable to uniformly distribute the values of $d_{(j \cdot L+i),k}$, since the voltage-light transmittance curve is not a straight line. It is preferable to select the value of $d_{(j \cdot L+i),k}$ depending on the voltage-light transmission curve to achieve the necessary light transmission for each and every gray shade level.

According to the first method of the present invention, a voltage is applied on the column electrode which is proportional to a voltage expressed by the following equation (8) to display data designated by $d_{(j \cdot L+i),k}$.

$$V_{c,n} = \sum_{i=1}^{L} \{\alpha_{in} d_{(j \cdot L+i),k}\} \pm \left( L - \sum_{i=1}^{L} |d_{(j \cdot L+i),k}|^2 \right)^{1/2} \tag{8}$$

It can be considered that the row electrode subgroup is driven by adding an imaginary row (a 0-th row), when the left hand side of the following equation (9) is regarded as data corresponding to the imaginary 0-th row.

$$\left( L - \sum_{i=1}^{L} |d_{(j \cdot L+i),k}|^2 \right)^{1/2} = d_{(j \cdot L+0),k} \tag{9}$$

±in (8) is determined so that a new selection voltage matrix is provided with the orthogonality.

That is to say, the equation (8) can be rewritten as follows, by putting the new selection voltage matrix having the 0-th row as $\{\alpha_{mn}'\}$.

$$V_{c,n} = \sum_{i=0}^{L} \{\alpha'_{in} d_{(j\cdot L+i),k}\} \tag{10}$$

For instance, when L=7, an orthogonal matrix A can be selected by determining K as K=8. As a representative example, a matrix of 7 rows and 8 columns as shown in Table 1 is exemplified wherein an arbitrary single row is eliminated from a so-called Hadamard's matrix of order 8. In this case, the first row wherein all the elements are provided with 1, is eliminated from the Hadamard's matrix of order 8.

TABLE 1

$$A_1 = \begin{bmatrix} 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{bmatrix}$$

When the matrix $A_1$ is employed as the selection voltage matrix, a selection voltage matrix $A_1'$ added with the imaginary row, is formed firstly by replacing the eliminated first row. Further, the selection signal is converted to an alternate current one by arranging $A_1'$ and $-A_1'$ into a single selection matrix, since the selection signal does not satisfy the dc free condition, in case wherein the selection matrix is $A_1'$. In this case, column voltage corresponding to $-A_1'$ is of the same amplitude and opposite sign to the column voltage corresponding to $A_1'$.

In this way, very many levels of gray shade display can be provided to the MLS method which is suitable for the fast responding LCDs, without substantially changing the frequency components of the driving waveform.

When $L=2^p$ (p is a positive integer), the size of the selection voltage matrix should be increased, to 2×L columns as explained earlier in order to accommodate the imaginary row.

Further, it is necessary to increase the size of the selection voltage matrix, in case of $L=2^p-1$ (p is an integer greater than 1), in order to meet the dc free condition.

The minimum necessary number of the selection pulses for performing a single display cycle, is $2^p$, in case of $L=2^p-2$ (p is an integer greater than 2), even when the dc free condition is considered, which is the same as in the MLS method for the bi-level display.

In this case, it is not necessary to perform the switching of the display data $D_j$ at a timing wherein all the selection voltage vectors constituting the selection voltage matrix have been applied on the electrodes. That is to say, the display data $D_j$ may be switched while the selection voltage vectors of the selection voltage matrix are successively applied on the electrodes (during a single display cycle). In such a case, more or less direct current components may be superposed on the driving signal, which is not often a big problem as a whole.

In this invention, as the selection voltage matrix, the selection voltage vectors constituting the selection voltage matrix may be selected so as to include all the possible kinds of selection voltage vectors. In this case, for instance, when L=8, K is $2^8=256$.

In this invention, when J=1, this is the case wherein all the row electrodes are simultaneously selected. Such a case has a merit wherein the voltage applied to the row electrode is provided with two levels, since there is no non-selection period. However, it is preferable to simultaneously select a suitable number of plural rows and scan them as above, since the hardware is extremely complicated, when J=1.

In order to simplify the driving circuit, it is preferable that the numbers of the row electrodes constituting the row electrode subgroups are all equal, in the driving method of this invention. Naturally, in the general cell construction, the total number of row electrodes is not always a multiple of the number of the row electrodes constituting the row electrode subgroup. Therefore, there is a case wherein it is not possible to equalize all the numbers of the row electrodes constituting the respective row electrode subgroups.

It is possible to drive voltages applied on the row electrodes and the column electrodes in the above case as in the case wherein the number of the row electrodes constituting the row electrode subgroup is L, by driving them by adding imaginary row electrodes of $(L-L_r)$, with respect to a portion composed of a row electrode subgroup consisted of row electrodes of $L_r$ the number of which is smaller than that of the other row electrode subgroups consisted of row electrodes of L.

That is to say, in case of driving the row electrode subgroup consisted of $L_r$ pieces of row electrodes, $(L-L_r)$ pieces of imaginary row electrodes corresponding to $L_r$-th, $(L_r+1)$-th , . . . L-th row electrodes, are imaginarily considered and the driving is performed by imaginarily selecting the display data on the imaginary row electrodes.

An example of a voltage applied on a liquid crystal, that is, a difference between a row electrode and a column electrode is shown for a pixel driven to 7th gray level from the off-state in FIG. 7, with respect to the first method of the present invention. The abscissa is time and the ordinate is voltage, each of which is provided with an arbitrary unit. The number of row electrodes of the row electrode subgroup is seven and the display is of 32 gray shades.

The second method of the present invention is applied to the MLS method as follows.

In this case, voltages which are in proportion to two kinds of voltages expressed by the following two equations are applied on the column electrodes, to display data represented by $d_{(j\cdot L+i),k}$.

$$V_{d1,n} = \sum_{i=1}^{L} \{\alpha_{in}(d_{(j\cdot L+i),k} + (1 - d^2_{(j\cdot L+i),k})^{1/2})\}; \tag{11}$$

$$V_{d2,n} = \sum_{i=1}^{L} \{\alpha_{in}(d_{(j\cdot L+i),k} - (1 - d^2_{(j\cdot L+i),k})^{1/2})\} \tag{12}$$

In the following, a period wherein a voltage designated by $V_{d1,n}$ is applied on the column electrode is defined as a first time slot, whereas a period wherein a voltage designated by $V_{d2,n}$, a second time slot. The order of application of the voltage corresponding to each time slot is arbitrary. It is preferable to disperse the two time slots in two display cycles to avoid the relaxation phenomena of a liquid crystal. Accordingly, it is preferable not to apply the selection pulses successively during the first and second time slots, and to perform a voltage application corresponding to the second time slot after selecting all the row electrode subgroups with voltage corresponding to the first time slot.

In the second method of the present invention, in order to meet the dc free condition in a cycle, it is necessary to increase the size of selection voltage matrix, when the number L of the simultaneously selected row electrodes is, $L=2^p$ (p is a positive integer).

In case of $L=2^p-1$ (p is an integer greater than 1), the minimum necessary number of the selection pulses for performing a single display cycle is $2^p$, even when the dc free condition is considered, which is the same as in the MLS method in case wherein the gray shade display is not performed.

An example of a voltage applied on a liquid crystal, that is, a difference between a row electrode voltage and a column electrode voltage is shown for a pixel driven to 7th gray level from the off-state in FIG. 8, with respect to the second method of the present invention. The abscissa is time and the ordinate is voltage, each of which is provided with an arbitrary unit. The number of row electrodes in a row electrode subgroup is seven and the display is provided with 32 gray shades as a total.

FIG. 4 shows an example of a circuit which is adopted to achieve the driving method of this invention.

Respective display data of R, G and B are inputted to a frame buffer memory 1 as input signals in digital forms. The display data on row electrode subgroups selected from the frame buffer memory 1 are sent to a column signal generator 2. Further, a predetermined row electrode selection pattern is sent from a row electrode sequence generator 3 to the column signal generator 2.

The column signal generator 2 performs a calculation based on the display data and the row electrode selection pattern thereby forming a column voltage, the arrangement of which is changed to a format which is suitable for transferring the data to a display panel by the buffer memory and a data formatter 4 and thereafter, the column voltage is sent to a D-A converter 5.

The display data converted from digital to analog at the D-A converter 5 is converted to an offset value and an amplitude which are suitable for an LCD driving by an offset and gain corrector 6 and sent to an analog type column driver 7. The outputs of the column driver are respectively connected to column input terminals of an LCD 8.

On the other hand, an output of the row electrode selection sequence generator 3 is also sent to a row electrode selection sequencer 9, wherein a timing thereof is adjusted to that of the display data on the row side and the output is sent to a row driver 10. The outputs of the three-level row driver 10 are respectively connected to row input terminals of the LCD 8.

FIG. 5 shows the construction of the column signal generator, among the circuits in case of performing the first method with respect to the MLS method.

L pieces of the display data $d_{(j\cdot L+i),k}$ (i=1, 2 , . . . , L) in a j-th subgroup, at a k-th column are respectively applied on display data input terminals of the column signal generator 2. This display data is squared by square calculators 11. An adder 12 performs addition of L pieces of the squared data. A function generator 13 along with elements 11 and 12 in FIG. 5 performs the calculation given by eq. (13), and the calculation result is inputted to sign determinaters 14.

The calculation by the square calculator 11 may be performed by writing a square table to a ROM and by reading it. Or, the square calculation may be performed by employing a multiplier constructed by actually employing random logic gates and the like. When the ROM is employed, the precalculated values stored into the ROM can be accessed directly and the speed is limited by access time of the ROM. On the other hand, the multiplier is provided with an advantage wherein the calculation can be performed at a higher speed. The function generator 13 may be employed by writing a predetermined calculation result to the ROM.

The outputs of the function generator 13 and L pieces of the display data are inputted to the sign determinaters 14 with outputs which are either true value or 2's complement of the data. Signs of the output of the function generator 13 and L pieces of the display data are determined by the sign determinaters 14. The determination of sign is performed in accordance with the selection voltage vector which is simultaneously inputted. Specifically, the data is treated by the sign determinaters 14 such that an addition is performed when the selection voltage vector is +1 and a subtraction is performed when the selection voltage vector is −1 and the treated data is sent to an adder 15. It is important to note that the calculation of function given by eq. (13) takes some time and no addition can be performed in the adder 15 until such time the calculation is completed in the function generator consisting of elements 11 to 13. This increases time necessary for the generation of the column signal. The selection voltage vector in this case is constructed by a new orthogonal matrix wherein the 0-th row component is added to the above selection voltage matrix. Thus the adder 15 performs the addition and subtraction of (L+1) of data, and outputs the calculated results as the column electrode signal.

In an example, wherein $L=2^P$, p being a positive integer, a matrix wherein the orthogonal matrix $\{\alpha_{mn}\}$ is combined with the orthogonal matrix $\{\alpha_{mn}\}$ to obtain the selection voltage matrix, when L rows electrodes are simultaneously selected.

In case of the orthogonal matrix $\{\alpha_{mn}\}$ as the selection voltage matrix, the voltage applied on the column electrode is proportional to $V_{d,1}$ of the following equation (14). In case of the orthogonal matrix $\{-\alpha_{mn}\}$ as the selection voltage matrix, the voltage applied on the column electrode is proportional to $V_{d,2}$ of the following equation (15). This is considered to correspond to displaying the data $$\left(L-\sum_{i=1}^{L}\{d^2_{(j\cdot L+i),k}\}\right)^{1/2} \tag{13}$$

by adding a single row as the 0-th row to the selection voltage matrix, the element of which is "1" with respect to the orthogonal matrix $\{\alpha_{mn}\}$ and the element "−1" with respect to the orthogonal matrix $\{\alpha_{mn}\}$.

$$V_{d1,n}=\sum_{i=1}^{L}\{\alpha_{in}d_{(j\cdot L+i),k}\}+\left(L-\sum_{i=1}^{L}\{d_{(j\cdot L+i),k}\}^2\right)^{1/2} \tag{14}$$

$$V_{d2,n}=\sum_{i=1}^{L}\{\alpha_{in}d_{(j\cdot L+i),k}\}-\left(L\sum_{i=1}^{L}\{d_{(j\cdot L+i),k}\}^2\right)^{1/2} \tag{15}$$

where $$\sum_{i=1}^{L}\{\ \}$$

shows a summing operation from i=1 through L with respect to a content of { }.

FIG. 6 shows the circuit construction of the column signal generator 2 for performing the second method of this invention with respect to the MLS method. L pieces of the display data $d_{(j\cdot L+i),k}$ (i=1, 2 , . . . L) in the j-th row subgroup, at the k-th column are respectively inputted to the display data input terminals of the column signal generator 2. The display data is inputted to sign determinaters 18 through switching means 20, after the display data are performed with a predetermined calculation by function generators 16 and 17.

The function generator 16 converts the display data to $F_{11}$ through $F_{L1}$ respectively. The function generator 17 converts the display data to $F_{12}$ through $F_{L2}$, where $$F_{i1}=d_{(j\cdot L+i),k}+(1-d_{(j\cdot L+i),k}{}^2)^{1/2} \tag{16},$$

$$F_{i2}=d_{(j\cdot L+i),k}-(1-d_{(j\cdot L+i),k}^{2})^{1/2} \quad (17).$$

The output of the function generator 16 is applied to the first time slot and the output of the function generator 17 is applied to the second time slot. The application may be performed in the reversed order. Although the time intervals of the two time slots should be equal, it is not necessary to apply the outputs successively during the two time slots, and the input switching may be performed every time the selection is finished on J pieces of the row electrode subgroups.

The function generators 16 and 17 may be constructed by random logic gates, and the switching means 20 can employ AND-OR gates. On the other hand, the calculation results of the function generators 16 and 17 may be stored into a ROM as a table, and the outputs of the function generators 16 and 17 may be selected by switching the address of the ROM in reading. According to the former, a higher-speed operation can be performed and according to the latter, a more simple hardware can be achieved.

Selection voltage vector is one of the inputs to each of L pieces of the sign determinaters 18 while the calculation results are the other input. The sign determinaters 18 perform the data treatment such that an addition is performed when the selection voltage vector is +1 and a subtraction is performed when the selection voltage vector is −1, and the outputs of the sign determinaters are the inputs of the adder 19. Thus the adder 19 performs the addition and subtraction of L pieces of the data and outputs the calculation results as the column electrode signal. A single display cycle is finished after performing the above calculation with respect to the selection voltage vectors the number of which is that of the column components of the selection voltage matrix. It is possible to further apply signals wherein the signs of the row voltage output and the column voltage output are reversed, if necessary.

The main advantage of this invention is a flicker free operation even in case of a large number of gray shade display as compared to the frame rate control method.

The first method of the present invention is characterized by that a correction voltage which is applied, such that the effective voltage applied to the element during the non-selection time is not dependent on the display pattern, can be considered to apply on an imaginary electrode which is not actually displayed, that is, (L+1)-th electrode. Accordingly, the length of sequence required for completing a single display cycle is same as that when there is no gray shading except when $L=2^{P}-1$ wherein the number of time interval is doubled for gray shading.

On the other hand, the second method of this invention is characterized by that a correction voltage which is applied dispersingly on L electrodes in the row electrode subgroup, such that the rms voltage applied across the pixel in the non-selected rows is independent of the display data. That is to say, the correction voltage is applied on the electrodes sequentially during the first time slot and the second time slot, and therefore, the length of sequence is doubled. However, the invention is provided with an advantage of simplifying the circuit structure, wherein time necessary for generation of column voltage is short as compared to the circuit of FIG. 5.

EXAMPLE

EXAMPLE 1

Figure 4:
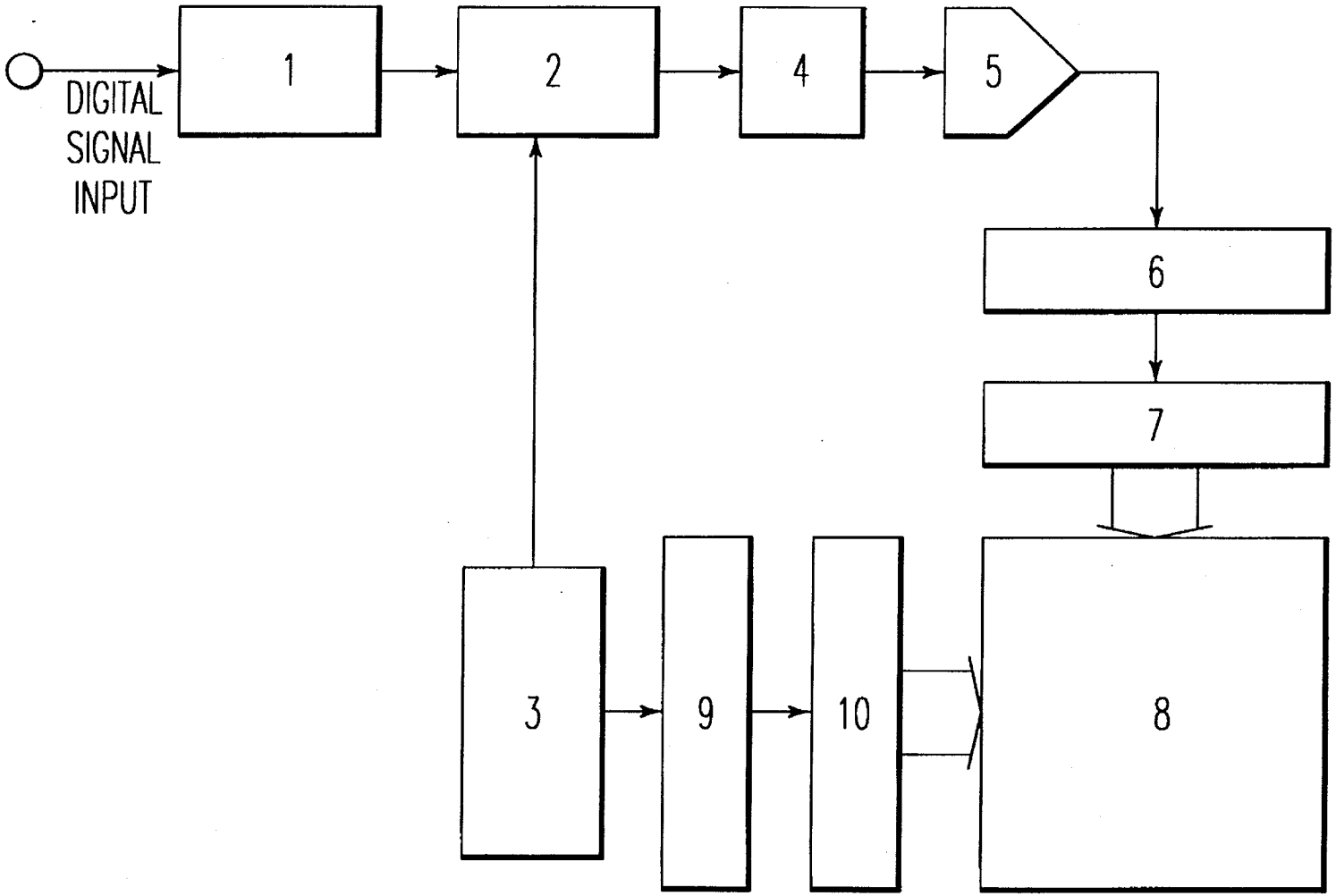
FIG. 4 shows an example of a block diagram of a circuit for achieving the invented method.
Figure 5:
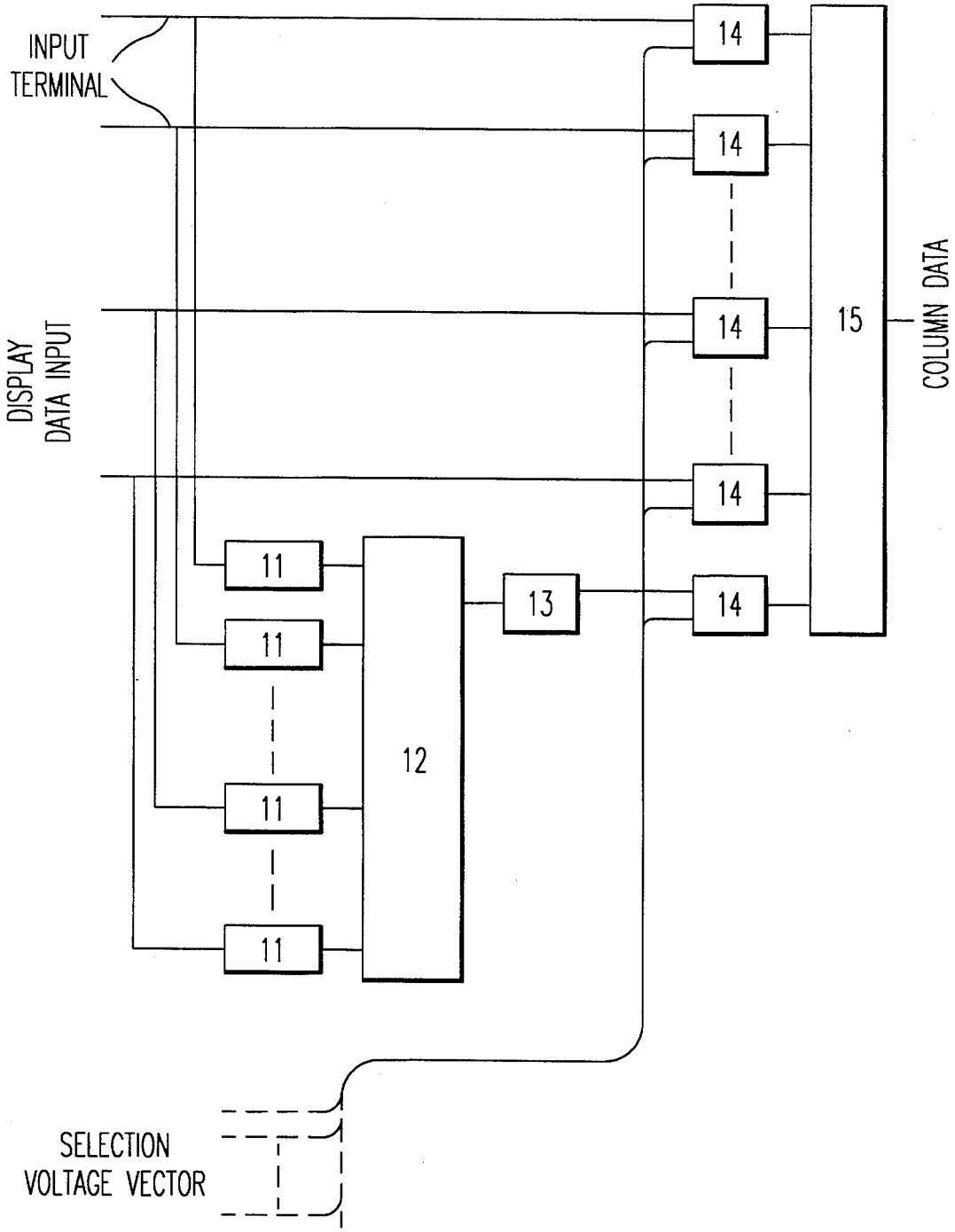
FIG. 5 is a block diagram showing an example of a column signal generating circuit for achieving the first method of this invention.

An STN liquid crystal display element having an average response time of 50 msec (at 25° C.) between on and off states, is driven by the driving method of this invention employing the circuit structure of FIGS. 4 and 5, wherein L=7, J=35 and K=8, and hence the total number of row electrodes (N) is equal to 245.

A selection voltage matrix is employed wherein the matrix $A_1$ shown in Table 1 and a matrix $-A_1$ wherein the sign of the element is reversed from that of the matrix $A_1$. The matrix $A_1$ is a matrix wherein the first row is eliminated from an Hadamard's matrix of order 8. The total number of selection voltage vectors is 16. Table 2 shows selection codes sequentially representing applied voltage wherein the applied voltage $V_r$ is designated by "+" and the applied voltage $-V_r$, "−". However in the actual application, selection is performed by selecting the successive row electrode subgroups sequentially one after another, thereby preventing the relaxation phenomena of a liquid crystal.

TABLE 2

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Row 1 | + | − | + | − | + | − | + | − | − | + | − | + | − | + | − | + |
| Row 2 | + | + | − | − | + | + | − | − | − | − | + | + | − | − | + | + |
| Row 3 | + | − | − | + | + | − | − | + | − | + | + | − | − | + | + | − |
| Row 4 | + | + | + | + | − | − | − | − | − | − | − | − | + | + | + | + |
| Row 5 | + | − | + | − | − | + | − | + | − | + | − | + | + | − | + | − |
| Row 6 | + | + | − | − | − | − | + | + | − | − | + | + | + | + | − | − |
| Row 7 | + | − | − | + | − | + | + | − | − | + | + | − | + | − | − | + |

Time periods corresponding to numbers allotted to the selection codes of Table 2 are designated by t1 through t16, respectively. Voltages applied to column electrodes during the time periods are in proportion to the following $C_{t1}$ through $C_{t16}$, thereby providing a maximum contrast ratio.

$C_{t1}=g_0+g_1+g_2+g_3+g_4+g_5+g_6+g_7$
$C_{t2}=g_0-g_1+g_2-g_3+g_4-g_5+g_6-g_7$
$C_{t3}=g_0+g_1-g_2-g_3+g_4+g_5-g_6-g_7$
$C_{t4}=g_0-g_1-g_2+g_3+g_4-g_5-g_6+g_7$
$C_{t5}=g_0+g_1+g_2+g_3-g_4-g_5-g_6-g_7$
$C_{t6}=g_0-g_1+g_2-g_3-g_4-g_5-g_6+g_7$
$C_{t7}=g_0+g_1-g_2-g_3-g_4-g_5+g_6+g_7$
$C_{t8}=g_0-g_1-g_2+g_3-g_4+g_5+g_6-g_7$
$C_{t9}=-C_{t1}$
$C_{t10}=-C_{t2}$
$C_{t11}=-C_{t3}$
$C_{t12}=-C_{t4}$
$C_{t13}=-C_{t5}$
$C_{t14}=-C_{t6}$
$C_{t15}=-C_{t7}$
$C_{t16}=-C_{t8}$ where $g_1$ through $g_7$ designate respective gray shade levels of the seven column electrodes, which are the value normalized between −1 and 1, as mentioned above. 32 gray shades are selected in this example.

Further, $$g_0=(7-(g_1^2+g_2^2+g_3^2+g_4^2+g_5^2+g_6^2+g_7^2))^{1/2} \quad (18).$$

Figure 1:
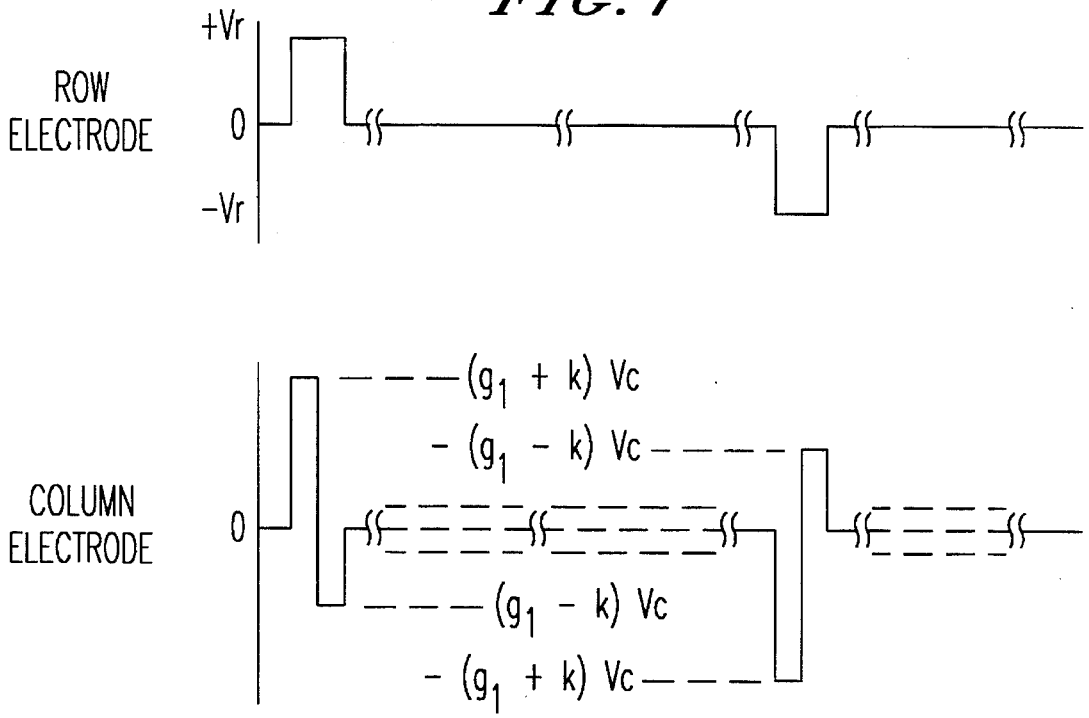
FIG. 1 shows an example of driving waveforms when amplitude modulation is applied to an APT.
Figure 2:
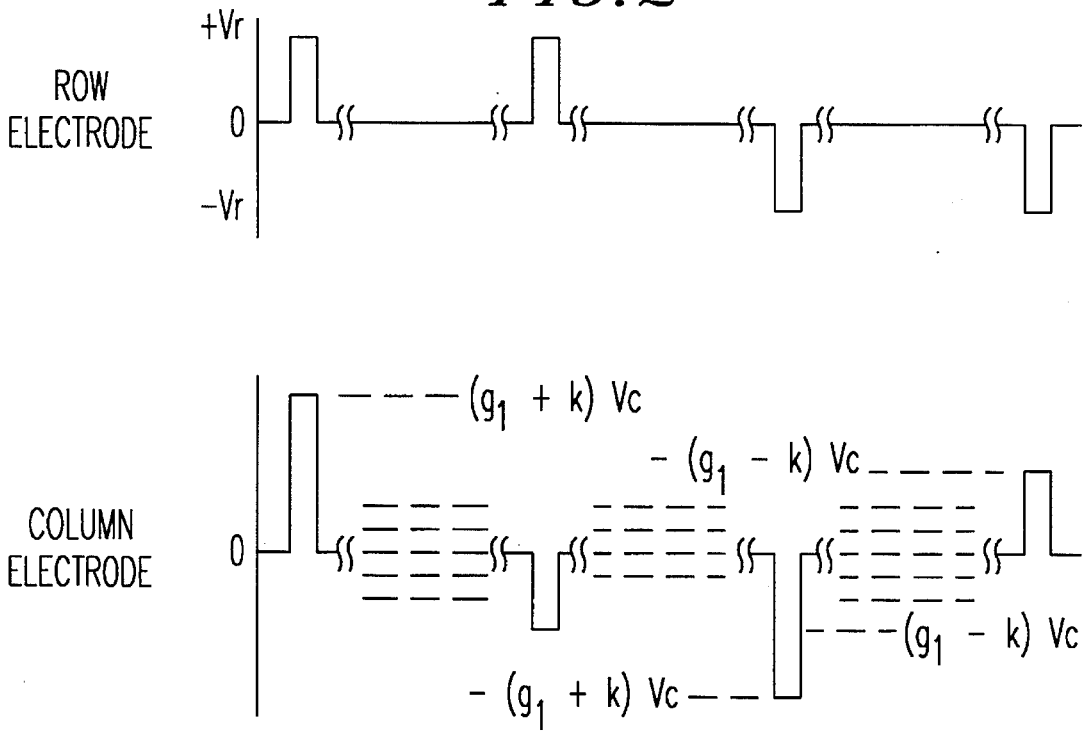
FIG. 2 shows another example of driving waveforms when amplitude modulation is applied to an APT.
Figure 3:
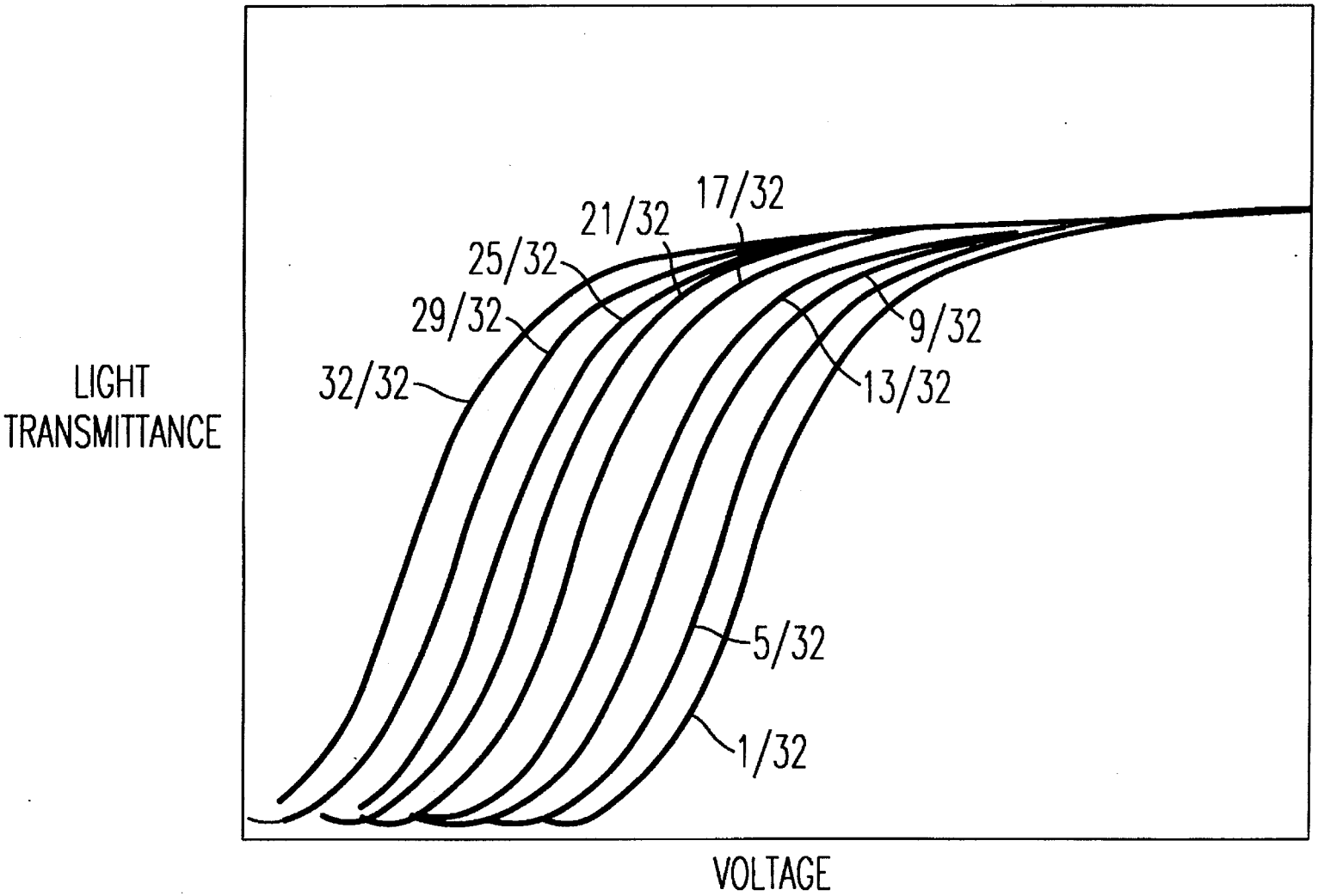
FIG. 3 shows graphs of the voltage-light transmittance-applied voltage curve according to the invented method.

FIG. 3 shows the light transmittance-applied voltage curves in this case. This example is performed with respect to the 32 gray shades. However, the graphs having the gray shades of an off state, 1st, 5th, 9th, 13th, 17th, 21st, 25th, 29th and 32nd are extracted and shown, for the easy observation of the diagram. In the diagram, i/32 designates that the graph is of the i-th gray shade level among 32 gray shade levels, which is counted from the off state. The abscissa is voltage and the ordinate, light transmittance.

Figure 9:
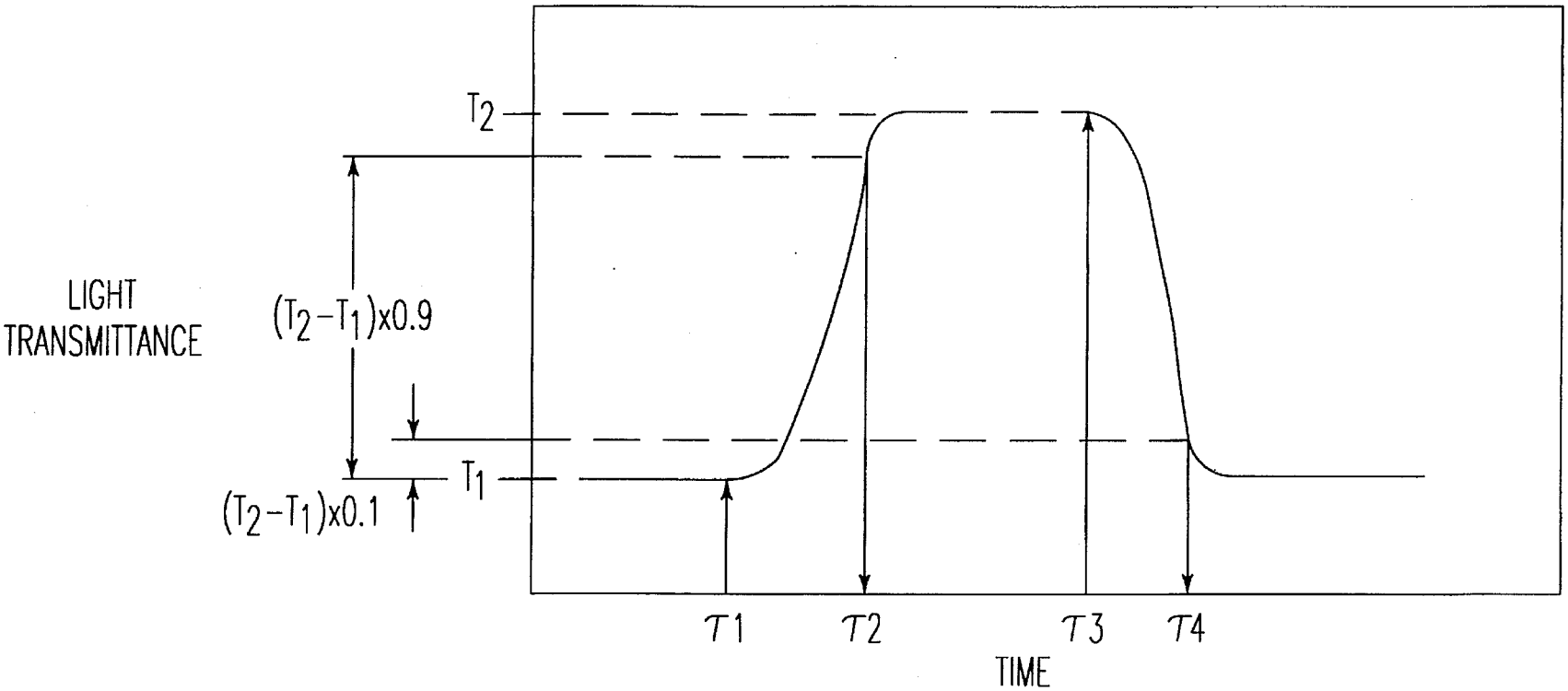
FIG. 9 is an explanatory diagram showing a response time of an LCD.

Further, response time for switching between various gray shades are shown in Tables 3 and 4. The response time in this case is defined in reference to FIG. 9 as follows. Steady state of light transmittance of a gray shade level is designated by $T_1$, steady state of light transmittance of another gray shade level is designated by $T_2$, a time point wherein the first gray shade is switched to the second gray shade, $\tau_1$, a time point thereafter, when the light transmittance T is $(T_2-T_1)\times 0.9+T_1$, $\tau_2$, a time point wherein the second gray shade is switched to the first gray shade, conversely, $\tau_3$, and a time point thereafter the light transmittance T is $(T_2-T_1)\times 0.1+T_1$, $\tau_4$. Then, the response time in a rise is $\tau_{rise}=\tau_2-\tau_1$, and the response time in a fall is $\tau_{fall}=\tau_4-\tau_3$. Table 3 shows the rise time, and Table 4, the fall time. Further, Ri designates an i-th gray shade counted from the off state, among gray shades whereby the light transmittance is approximately divided into seven equal intervals between the off state and the on state.

The unit is msec.

TABLE 3

| | | | | | | | |
|---|---|---|---|---|---|---|---|
| R1 | 97 | 109 | 111 | 115 | 108 | 95 | 66 |
| | R2 | 99 | 103 | 105 | 99 | 85 | 61 |
| | | R3 | 85 | 97 | 94 | 80 | 56 |
| | | | R4 | 100 | 94 | 82 | 58 |
| | | | | R5 | 101 | 79 | 53 |
| | | | | | R6 | 57 | 48 |
| | | | | | | R7 | 51 |
| | | | | | | | R8 |

TABLE 4

| | | | | | | | |
|---|---|---|---|---|---|---|---|
| R1 | | | | | | | |
| 57 | R2 | | | | | | |
| 54 | 88 | R3 | | | | | |
| 51 | 84 | 83 | R4 | | | | |
| 52 | 84 | 92 | 104 | R5 | | | |
| 56 | 88 | 98 | 106 | 113 | R6 | | |
| 55 | 84 | 95 | 102 | 102 | 75 | R7 | |
| 60 | 86 | 97 | 104 | 101 | 90 | 82 | R8 |

The Tables 3 and 4 reveal that the response time changes by a ratio of approximately two at maximum.

EXAMPLE 2

An STN liquid crystal display element having a circuit construction similar to that in Example 1 wherein the mean response speed is 50 msec (at 25° C.) at 2 gray shades, is driven by the driving method of this invention, wherein L=3, J=80, and K=4 with respect to 240 of the number N of column electrodes.

TABLE 5

$$A_2=\begin{Bmatrix} 1 & -1 & 1 & 1 \\ 1 & 1 & -1 & -1 \\ 1 & -1 & -1 & 1 \end{Bmatrix}$$

As the selection voltage matrix, a matrix wherein a matrix $A_2$ shown in Table 5 and a matrix $-A_2$ wherein the sign of the element is reversed from that in the matrix $A_2$, are arranged, is employed. $A_2$ is a matrix wherein the first column is eliminated from a Hadamard's matrix of order 4. The number of a total of the selection voltage vectors is 8. Table 6 shows the selection codes wherein the applied voltage is sequentially shown in which the applied voltage $+V_r$ is designated by "+", and the applied voltage $-V_r$, "−". However, in the actual application, the voltage application is performed to a succeeding row electrode subgroup every time a voltage corresponding to a selection code is applied to a preceding row electrode subgroup, thereby preventing the relaxation phenomena of a liquid crystal.

TABLE 6

| | 1 | 2 | 3 | 4 | 5 | 6 | 7 | 8 |
|---|---|---|---|---|---|---|---|---|
| Row 1 | + | − | + | − | − | + | − | + |
| Row 2 | + | + | − | − | − | − | + | + |
| Row 3 | + | − | − | + | − | + | + | − |

Time periods respectively corresponding to numbers allotted to the selection codes of Table 6 are designated by t1 through t8. The voltages applied to the column electrodes in the time periods are in proportion to $C_{t1}$ through $C_{t8}$, to thereby provide a maximum contrast ratio.

$C_{t1}=g_0+g_1+g_2+g_3$
$C_{t2}=g_0-g_1+g_2-g_3$
$C_{t3}=g_0+g_1-g_2-g_3$
$C_{t4}=g_0-g_1-g_2+g_3$
$C_{t5}=-C_{t1}$
$C_{t6}=-C_{t2}$
$C_{t7}=-C_{t3}$
$C_{t8}=-C_{t4}$ where $g_1$ through $g_3$ designate the respective gray shade levels of three pieces of the row electrodes, which are the values normalized between −1 and 1, as mentioned above. 32 Gray shades are selected in this example.

Further, $$g_0=(3-(g_1^2+g_2^2+g_3^2))^{1/2} \quad (19).$$

The display switching is performed at a high speed and a multi-level gray shades are provided by this method.

EXAMPLE 3

An STN liquid crystal display element having the average response time of 50 msec at 25° C. between on and off states is driven by the driving method of this invention employing a circuit construction similar to that in Example 1, wherein L=3, J=80 and K=8, and hence the total number of row electrodes (N) is equal to 240.

TABLE 7

$$A_3 = \left\{ \begin{matrix} 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{matrix} \right\}$$

In this occasion, a matrix wherein a matrix $A_3$ shown in Table 7 and $-A_3$ are arranged, as the selection voltage matrix. $A_3$ is an orthogonal matrix including column vectors having elements of all the conceivable combination of +1 and −1. The number of a total of the selection voltage vector is 16. Table 8 shows the selection codes which sequentially show the applied voltage wherein the applied voltage $+V_r$ is designated by "+" and the applied voltage $-V_r$, "−". However in the actual application, the voltage application is performed to a succeeding row electrode subgroup at every time a voltage corresponding to a selection code is applied to a preceding row electrode subgroup thereby preventing the relaxation phenomena of a liquid crystal.

TABLE 8

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Row 1 | + | − | + | − | − | + | − | + | − | + | − | + | + | − | + | − |
| Row 2 | + | + | − | − | − | − | + | + | − | + | + | + | + | − | − | |
| Row 3 | + | − | − | + | − | + | + | − | − | + | + | − | + | − | − | + |

Time periods respectively corresponding to numbers allotted to the selection codes of Table 8 are designated by t1 through t16. The voltage applied to the column electrode in the time period is in proportion to the following $C_{t1}$ through $C_{t16}$, to thereby provide a maximum contrast ratio.

$C_{t1}=g_0+g_1+g_2+g_3$
$C_{t2}=g_0-g_1+g_2-g_3$
$C_{t3}=g_0+g_1-g_2-g_3$
$C_{t4}=g_0-g_1-g_2+g_3$
$C_{t5}=g_0-g_1-g_2-g_3$
$C_{t6}=g_0+g_1-g_2+g_3$
$C_{t7}=g_0-g_1+g_2+g_3$
$C_{t8}=g_0+g_1+g_2-g_3$
$C_{t9}=-C_{t1}$
$C_{t10}=-C_{t2}$
$C_{t11}=-C_{t3}$
$C_{t12}=-C_{t4}$
$C_{t13}=-C_{t5}$
$C_{t14}=-C_{t6}$
$C_{t15}=-C_{t7}$
$C_{t16}=-C_{t8}$

In the above equations, $g_1$ through $g_3$ designate the respective gray shade levels of three pieces of the row electrodes, which are the values normalized between −1 and 1, as mentioned above. 32 Gray shades are selected also in this example.

Further, $$g_0=(3-(g_1^2+g_2^2+g_3^2))^{1/2} \quad (20).$$

The display switching is performed at a high speed and multi-level gray shades having good brightness uniformity of display is provided by this method.

EXAMPLE 4

Figure 6:
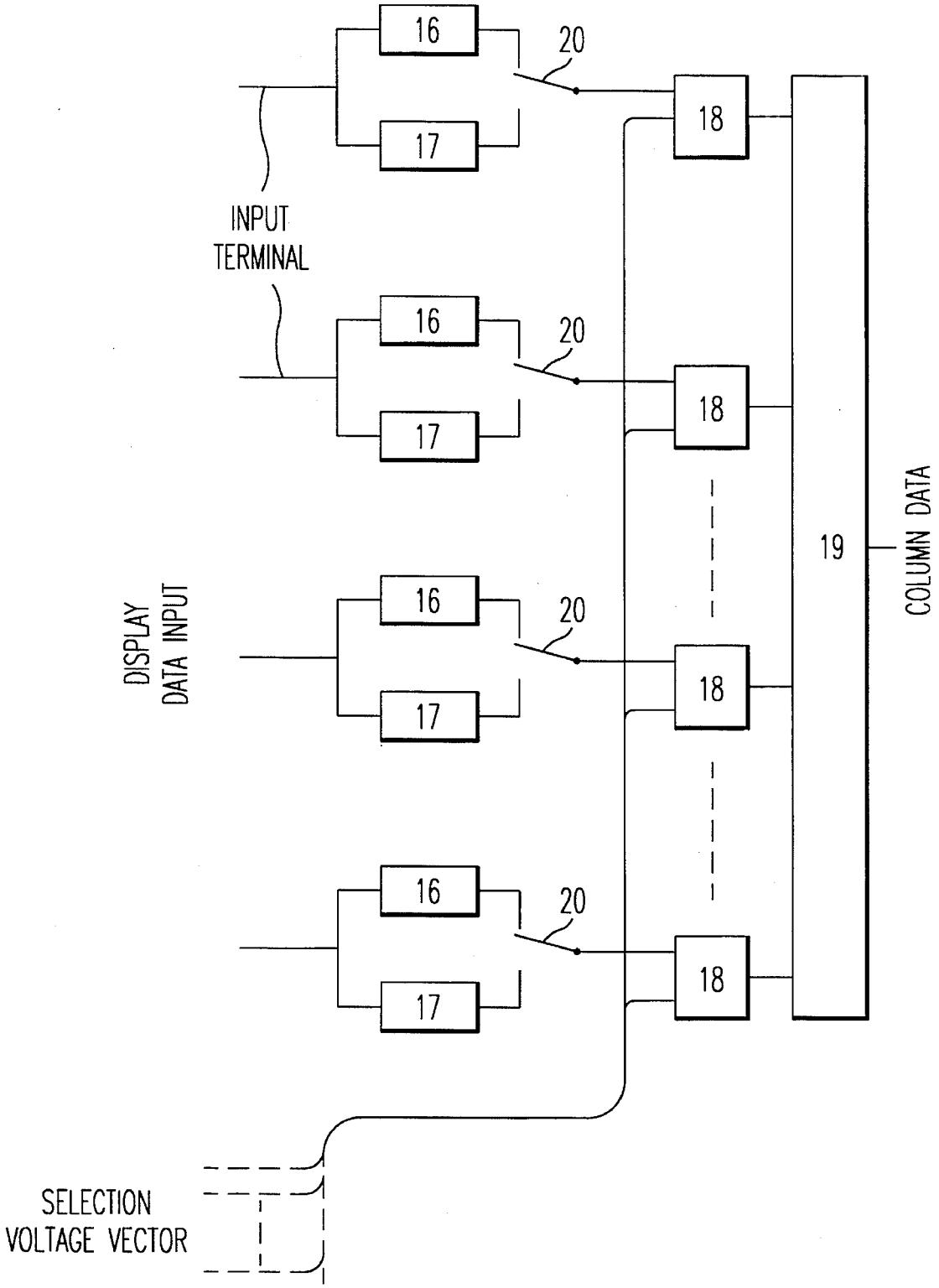
FIG. 6 is a block diagram showing another example of a column signal generating circuit for achieving the second method of this invention.
Figure 7:
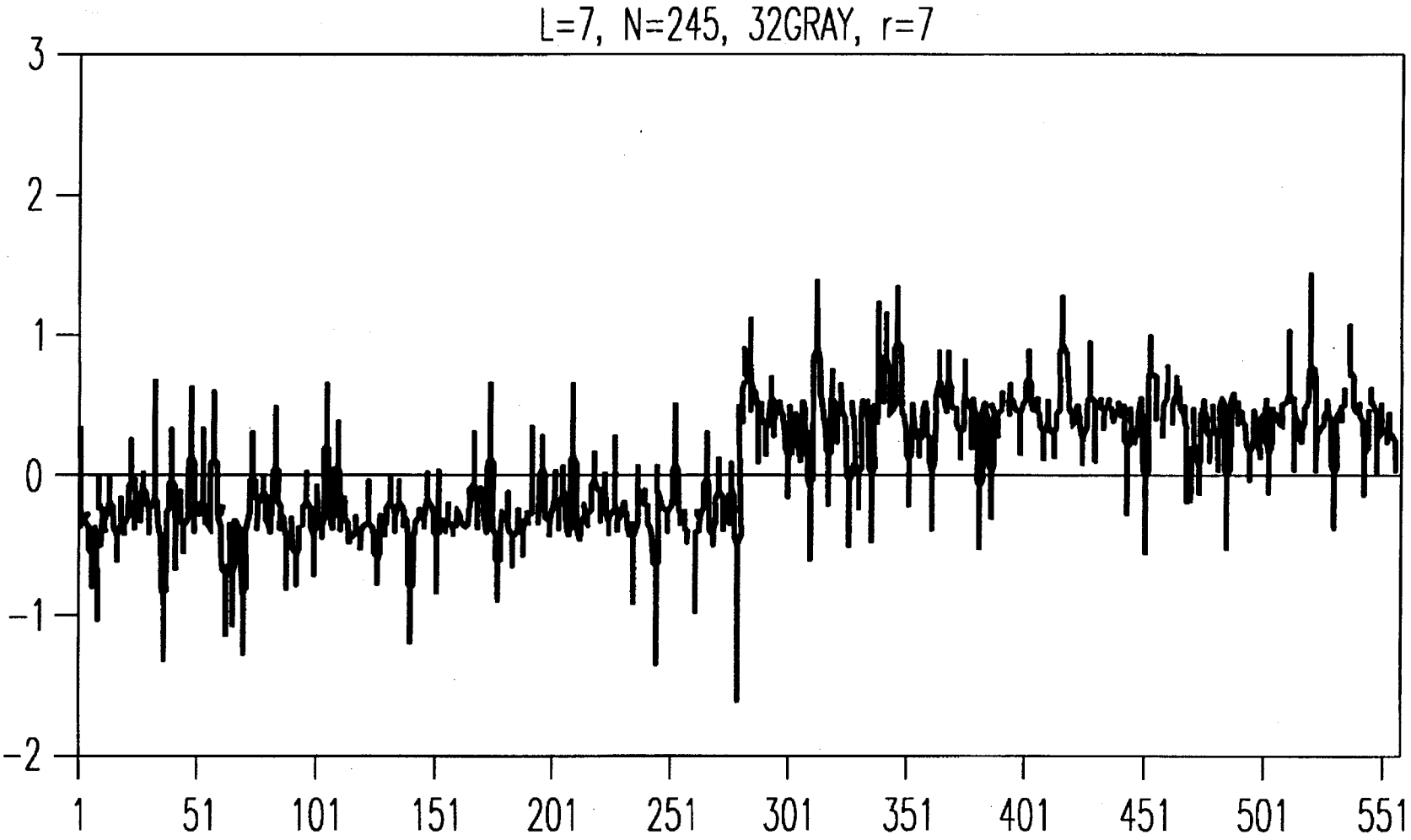
FIG. 7 shows an example of a voltage waveform applied on a liquid crystal according to the first method of this invention.
Figure 8:
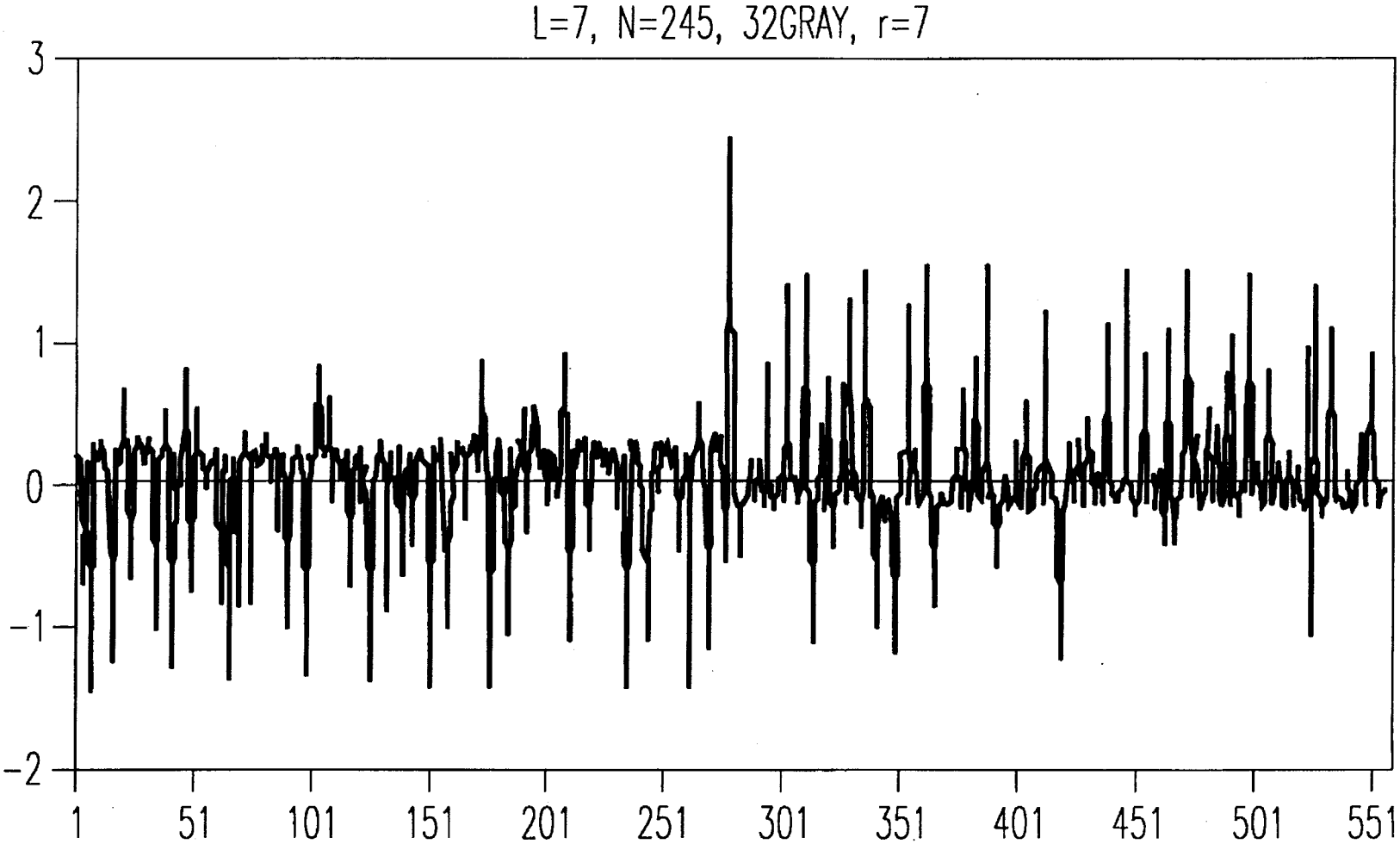
FIG. 8 shows an example of a voltage waveform applied on a liquid crystal according to the second method of this invention.

An STN liquid crystal display element having an average response time of 50 msec (at 25° C.) between on and off states, is driven by the driving method of this invention employing the construction of FIGS. 4 and 6, wherein L=7, and J=35 and hence the total number of row electrodes (N) is equal to 245.

A matrix wherein the first row is eliminated from a Hadamard's matrix of order 8, is adopted as the selection voltage matrix. Table 9 shows the selection codes which sequentially represents the applied voltage wherein the applied voltage $+V_r$ is designated by "+", and the applied voltage $-V_r$, "−".

TABLE 9

| | 1 | 2 | 3 | 4 | 5 | 6 | 7 | 8 |
|---|---|---|---|---|---|---|---|---|
| Row 1 | + | − | + | − | + | − | + | − |
| Row 2 | + | + | − | − | + | + | − | − |

TABLE 9-continued

| | 1 | 2 | 3 | 4 | 5 | 6 | 7 | 8 |
|---|---|---|---|---|---|---|---|---|
| Row 3 | + | − | − | + | + | − | − | + |
| Row 4 | + | + | + | + | − | − | − | − |
| Row 5 | + | − | + | − | − | + | − | + |
| Row 6 | + | + | − | − | − | − | + | + |
| Row 7 | + | − | − | + | − | + | + | − |

Time periods corresponding to numbers allotted to the selection codes of Table 9 are designated by t1 through t8, respectively. The voltage applied to the column electrode in the above time period is in proportion to the following $C_{1,x}$ through $C_{8,x}$ (x=1 correspond to a first time slot, x=2, a second time slot), to thereby provide a maximum contrast ratio.

$C_{1,1}=G_{1,1}+G_{2,1}+G_{3,1}+G_{4,1}+G_{5,1}+G_{6,1}G_{7,1}$
$C_{1,2}=+G_{1,2}+G_{2,2}+G_{3,2}+G_{4,2}+G_{5,2}+G_{6,2}+G_{7,2}$
$C_{2,1}=-G_{1,1}+G_{2,1}-G_{3,1}+G_{4,1}-G_{5,1}+G_{6,1}-G_{7,1}$
$C_{2,2}=-G_{1,2}+G_{2,2}-G_{3,2}G_{4,2}-G_{5,2}+G_{6,2}-G_{7,2}$
$C_{3,1}=+G_{1,1}-G_{2,1}-G_{3,1}+G_{4,1}+G_{5,1}-G_{6,1}-G_{7,1}$
$C_{3,2}=+G_{1,2}-G_{2,2}-G_{3,2}+G_{4,2}+G_{5,2}-G_{6,2}-G_{7,2}$
$C_{4,1}=-G_{1,1}-G_{2,1}+G_{3,1}+G_{4,1}-G_{5,1}-G_{6,1}+G_{7,1}$ $C_{4,2}=-G_{1,2}-G_{2,2}+G_{3,2}+G_{4,2}-G_{5,2}-G_{6,2}+G_{7,2}$
$C_{5,1}=+G_{1,1}+G_{2,1}+G_{3,1}-G_{4,1}-G_{5,1}-G_{6,1}-G_{7,1}$
$C_{5,2}=+G_{1,2}+G_{2,2}+G_{3,2}-G_{4,2}-G_{5,2}-G_{6,2}-G_{7,2}$
$C_{6,1}=-G_{1,1}+G_{2,1}-G_{3,1}-G_{4,1}+G_{5,1}-G_{6,1}+G_{7,1}$
$C_{6,2}=-G_{1,2}+G_{2,2}-G_{3,2}-G_{4,2}+G_{5,2}-G_{6,2}+G_{7,2}$
$C_{7,1}=+G_{1,1}-G_{2,1}-G_{3,1}-G_{4,1}-G_{5,1}+G_{6,1}+G_{7,1}$
$C_{7,2}=+G_{1,2}-G_{2,2}-G_{3,2}-G_{4,2}-G_{5,2}+G_{6,2}+G_{7,2}$
$C_{8,1}=-G_{1,1}-G_{2,1}+G_{3,1}-G_{4,1}+G_{5,1}+G_{6,1}-G_{7,1}$
$C_{8,2}=-G_{1,2}-G_{2,2}+G_{3,2}-G_{4,2}+G_{5,2}+G_{6,2}-G_{7,2}$ where $$G_{n,1}=\alpha_{in}(d_{(j\cdot L+i),k}+(1-d_{(j\cdot L+i),k}^2)^{1/2}) \quad (21)$$

$$G_{n,2}=\alpha_{in}(d_{(j\cdot L+i),k}-(1-d_{(j\cdot L+i),k}^2)^{1/2}) \quad (22)$$

In the actual voltage application, at every time a voltage corresponding to a first time slot is applied to a preceeding row electrode subgroup, the voltage application is performed to a succeeding row electrode subgroup, to thereby prevent the relaxation phenomena of a liquid crystal.

The light transmittance-applied voltage curve in this case is similar to the gray shade display performed by the circuit construction shown in FIG. 5. Further, the changes of the response times among respective gray shades are as small as in the case in FIG. 5.

According to the present invention, a multi-level gray shade display can be performed with a small variation of the frequency components across the pixels. The amplitude modulation can be used in combination with MLS method which has already been proposed by the applicants to drive fast responding LCDs.

According to the first method of this invention, the length of sequence required for completing a single display cycle is almost the same as that of the conventional techniques. According to the second method of this invention, the invention is provided with a merit of simplifying the circuit construction with the number of time intervals in a cycle being twice that of the conventional technique.

Further, it is clear that the driving method of this invention is not limited to a liquid crystal display element, and can be employed in a display element, so far as the light transmittance of a pixel selected by a row electrode and a column electrode changes in accordance with a difference of voltage applied on the row electrode and the column electrode.

We claim:

1. A method of driving a display element wherein a light transmittance of a pixel selected by a row electrode and a column electrode changes in accordance with a difference between voltages applied on the row electrode and the column electrode, which satisfies the following conditions;

(1) row electrodes are divided into a plurality of row electrode subgroups composed of L row electrodes which are selected simultaneously wherein L is an integer greater than 1;

(2) signals $\{\alpha_{mn}\}$ where $\alpha_{mn}$ is an element of a m-th row component and a n-th column component of an orthogonal matrix, m is an integer of 1 through L and n is a suffix showing that the n-th column component of the orthogonal matrix corresponds to a n-th selection signal in a single display cycle are applied on the selected row electrodes as row electrode signals; and (3) first voltages proportional to two kinds of second voltages ($V_{d1,N}$ and $V_{d2,N}$) expressed by the following equations are substantially applied to a column electrode to provide a predetermined gray shade level $d_{(j\cdot L+i),k}$ which is a value between 1 showing an off state and −1 showing an on state in accordance with a degree of gray shade with respect to a pixel of a k-th column where k is an integer and an i-th row where i is an integer of 1 through L of a j-th row electrode subgroup where j is an integer:

$$V_{d1,n}=\sum_{i=1}^{L}\{\alpha_{in}(d_{(j\cdot L+i),k}+(1-d_{(j\cdot L+i),k}^2)^{1/2})\} \quad (3)$$

$$V_{d2,n}=\sum_{i=1}^{L}\{\alpha_{in}(d_{(j\cdot L+i),k}-(1-d_{(j\cdot L+i),k}^2)^{1/2})\} \quad (4)$$

where $$\sum_{i=1}\{\ \}$$

indicates a summing operation of a content of { } with respect to i=1 through L.

2. The method of driving a display element according to claim 1, wherein the number L of the simultaneously selected row electrodes satisfies $$L=2^p-1,$$

where p is an integer greater than 1.

3. The method of driving a display element according to claim 1, wherein the display element is a liquid crystal display element.

4. The method of driving a display element according to claim 3, wherein selected pulses are dispersingly applied on the row electrodes in the single display cycle to whereby prevent relaxation phenomena of a liquid crystal.

5. The method of driving a display element according to claim 3, wherein $V_{d1,n}$ and $V_{d2,n}$ are dispersingly applied on the column electrodes in two display cycles to thereby prevent relaxation phenomena of a liquid crystal.

6. A driving device of a display element for driving a display element wherein a light transmittance of a pixel selected by a row electrode and a column electrode changes in accordance with a difference between voltages applied on the row electrode and the column electrode by dividing row electrodes into a plurality of row electrode subgroups composed of L row electrodes which are selected simultaneously wherein L is an integer greater than 1;

wherein a column signal generating device in the driving device comprises the following elements to provide a predetermined gray shade level $d_{(j\cdot L+i),k}$, which is a value between 1 showing an off state and −1 showing an on state in accordance with a degree of gray shade with respect to a pixel of a k-th column where k is an integer and an i-th row where i is an integer of 1 through L of a j-th row electrode subgroup where j is an integer:

(1) a first function generating means for generating a first function of $$F_{i1}=d_{(j\cdot L+i),k}+(1-d_{(j\cdot L+i),k}^2)^{1/2} \quad (6)$$

with respect to a display data $d_{(j\cdot L+i),k}$ corresponding to a predetermined gray shade level;

(2) a second function generating means for generating a second function of $$F_{i2}=d_{(j\cdot L+i),k}-(1-d_{(j\cdot L+i),k}^2)^{1/2} \quad (7)$$

by inputting the display data $d_{(j\cdot L+i),k}$ corresponding to a predetermined gray shade level;

(3) a sign determining means for determining signs of $F_{i1}$ and $F_{i2}$ in accordance with an orthogonal function signal $\{\alpha_{mn}\}$ where $\alpha_{mn}$ is an element of a m-th row component and a n-th column component of an orthogonal matrix, m is an integer of 1 through L and n is an suffix showing that the n-th column component of the orthogonal matrix corresponds to a n-th selection signal in a single display cycle;

(4) a switching means for switching outputs of the first and the second function determining means of which signs are to be determined by the sign determining means at a predetermined timing; and (5) an adding means for adding $F_{i1}$ and $F_{i2}$ of which signs have been determined by the sign determining means.

7. The driving device of a display element according to claim 6, wherein the first or the second function generating means is constructed by random logic gates and the switching means is constructed by an AND-OR gate.

8. The driving device of a display element according to claim 6, wherein the first or the second function generating means is constructed by storing a result of calculation corresponding to a predetermined gray shade level into a ROM and the switching means is constructed by a means for switching an address with respect to the ROM in reading.

9. The driving device of a display element according to claim 6, wherein the display element is a liquid crystal display element.

10. A display device wherein a light transmittance of a pixel selected by a row electrode and a column electrode changes in accordance with a difference between voltages applied on the row electrode and the column electrode, comprising:

(1) a row signal generating device generating substantially orthogonal signals which are applied on L row electrodes simultaneously wherein L is an integer greater than 1; and (2) a column signal generating device which comprises: the following elements to provide a predetermined gray shade level $d_{(j\cdot L+i),k}$, which is a value between 1 showing an off state and −1 showing an on state in accordance with a degree of gray shade with respect to a pixel of a k-th column where k is an integer and an i-th row where i is an integer of 1 through L of a j-th row electrode subgroup where j is an integer:

(i) a first function generating means for generating a first function of $$F_{i1}=d_{(j\cdot L+i),k}+(1-d_{(j\cdot L+i),k}^{2})^{1/2} \quad (6)$$

with respect to a display data $d_{(j\cdot L+i),k}$ corresponding to a predetermined gray shade level;

(ii) a second function generating means for generating a second function of $$F_{i2}=d_{(j\cdot L+i),k}-(1-d_{(j\cdot L+i),k}^{2})^{1/2} \quad (7)$$

by inputting the display data $d_{(j\cdot L+i),k}$ corresponding to a predetermined gray shade level;

(iii) a sign determining means for determining signs of $F_{i1}$ and $F_{i2}$ in accordance with an orthogonal function signal $\{\alpha_{mn}\}$ where $\alpha_{mn}$ is an element of a m-th row component and a n-th column component of an orthogonal matrix, m is an integer of 1 through L and n is a suffix showing that the n-th column component of the orthogonal matrix corresponds to a n-th selection signal in a single display cycle;

(iv) a switching means for switching outputs of the first and the second function determining means of which signs are to be determined by the sign determining means at a predetermined timing; and (v) an adding means for adding $F_{i1}$ and $F_{i2}$ of which signs have been determined by the sign determining means.

* * * * *